United States Patent [19]

de Bruyne

[11] 4,183,677

[45] Jan. 15, 1980

[54] MECHANISM FOR EFFECTING ORBITAL MOTION OF A MEMBER

[76] Inventor: Norman A. de Bruyne, 3700 Brunswick Pike, Princeton, N.J. 08540

[21] Appl. No.: 938,707

[22] Filed: Aug. 31, 1978

[30] Foreign Application Priority Data

Sep. 7, 1977 [GB] United Kingdom ..... 37343/77

[51] Int. Cl.[2] ..... B01F 11/00

[52] U.S. Cl. ..... 366/209; 74/44

[58] Field of Search ..... 366/209, 208, 212; 74/44, 48

[56] References Cited

U.S. PATENT DOCUMENTS

| | | | |
|---|---|---|---|
| 2,809,020 | 10/1957 | Magee et al. | 366/208 |
| 2,829,528 | 4/1958 | Hulick, Jr. | 366/208 X |
| 2,976,792 | 3/1961 | Chambers | 366/208 X |

OTHER PUBLICATIONS

*How to Buy a Shaker That Lasts,* New Brunswick Scientific Co., Inc.

*Primary Examiner*—Billy S. Taylor

*Attorney, Agent, or Firm*—Richard C. Woodbridge

[57] ABSTRACT

A shaker apparatus includes structure for effecting orbital motion in a beam member which forms a part of the apparatus. The beam includes two spaced apart points located at opposite ends of the beam. A set of resiliently flexible metal spring means in the form of a rectangle has two of its sides respectively connected to the two spaced apart points on the beam. The other two remaining sides of the rectangle are connected to two fixed supports. The relationship between the two fixed supports and the two points on the beam is such that an imaginary line joining the two points on the beam member is transverse to and intersected by an imaginary line joining the two fixed supports. The beam is driven by a flywheel and crank mechanism which in turn is driven by a synchronous motor or a pair of synchronous motors. A pair of rigid crossed wires may be employed to brace the opposite corners of the spring rectangular in order to prevent angular oscillation of the beam member during orbital motion.

16 Claims, 7 Drawing Figures

MECHANISM FOR EFFECTING ORBITAL MOTION OF A MEMBER

BACKGROUND OF THE INVENTION

1. Field of the Invention

This invention relates to a mechanism for producing orbital motion in a member of the mechanism.

2. Description of the Prior Art

A variety of shakers are known to those of ordinary skill in the art. In general shakers can be divided into classes depending upon their functions and purposes. Some shakers are designed exclusively for reciprocating motion whereas others are designed exclusively for orbital motion. Reciprocating motion is the first choice for dissolving powders in liquids, for solvent extraction in which two immissible solvents have to be shaken together, or for accelerating chemical reactions. Orbital shaking is the first choice for cultures as it eliminates wetting of the cotton hole plug in the neck of the flask and the smooth swirling motion provides more reproducable results. Similarly, many are designed for shaking materials under ambient conditions or in incubators whereas others are adapted for use with a water bath. The following foreign organizations are known to make shakers for use under ambient conditions or in incubators: Braun (Germany), Cenco (Holland), Desaga (Germany), Gerhardt (Germany), Weidolth (Germany), and Infors (Switzerland). The following organizations make and/or sell the same types of shakers in the United States: Eberbach, Fischer, Labline, New Brunswick Scientific Company, Inc., and Spectroderm Instruments, Inc.

Lauda of Germany is known to manufacture a water bath shaker. The following organizations also sell water bath shakers in the United States: Blue M, Eberbach, Labline, New Brunswick Scientific Company, Inc., Precision, Warner-Chilcott, and American Optical.

Prior art shakers tend to be either reciprocating or orbital, but not both. In addition, they can be relatively expensive to purchase and can be expensive to run due to their power consumption requirements. The New Brunswick "Aquatherm" Model Water bath shaker can be converted from reciprocating to orbital shaking by removing three fasteners and replacing the driving unit. It is believed that none of the well known shakers can be used either as a water bath shaker or as a regular conventional shaker with a choice of reciprocating or orbital motions. It is in the context of the foregoing prior art that the present invention arose.

SUMMARY OF THE INVENTION

Briefly described the invention comprises a shaker mechanism that may be selectively used either as an orbital shaker or a reciprocating shaker. The apparatus comprises a beam having two spaced apart points thereon which are connected respectively to two sides of a rectangular resiliently flexible metal spring means. The two remaining free sides of the resiliently flexible metal spring means are connected to two fixed supports. An imaginary line joining said two points on said member is transverse to and intersected by an imaginary line joining said two fixed supports. According to one embodiment of the invention, two synchronous motors are employed to drive a pulley mechanism which in turn is connected to a crank and flywheel structure which drives the beam. According to another embodiment of the invention a single synchronous motor drives a friction wheel which directly impinges upon the flywheel drive means. According to both embodiments means are employed to adjust the speed of the device and to select between orbital and reciprocating modes of operation. These and other features of the invention will be more fully understood with reference to the following drawings and detailed description of the invention.

DETAILED DESCRIPTION OF THE INVENTION

Figure 1:
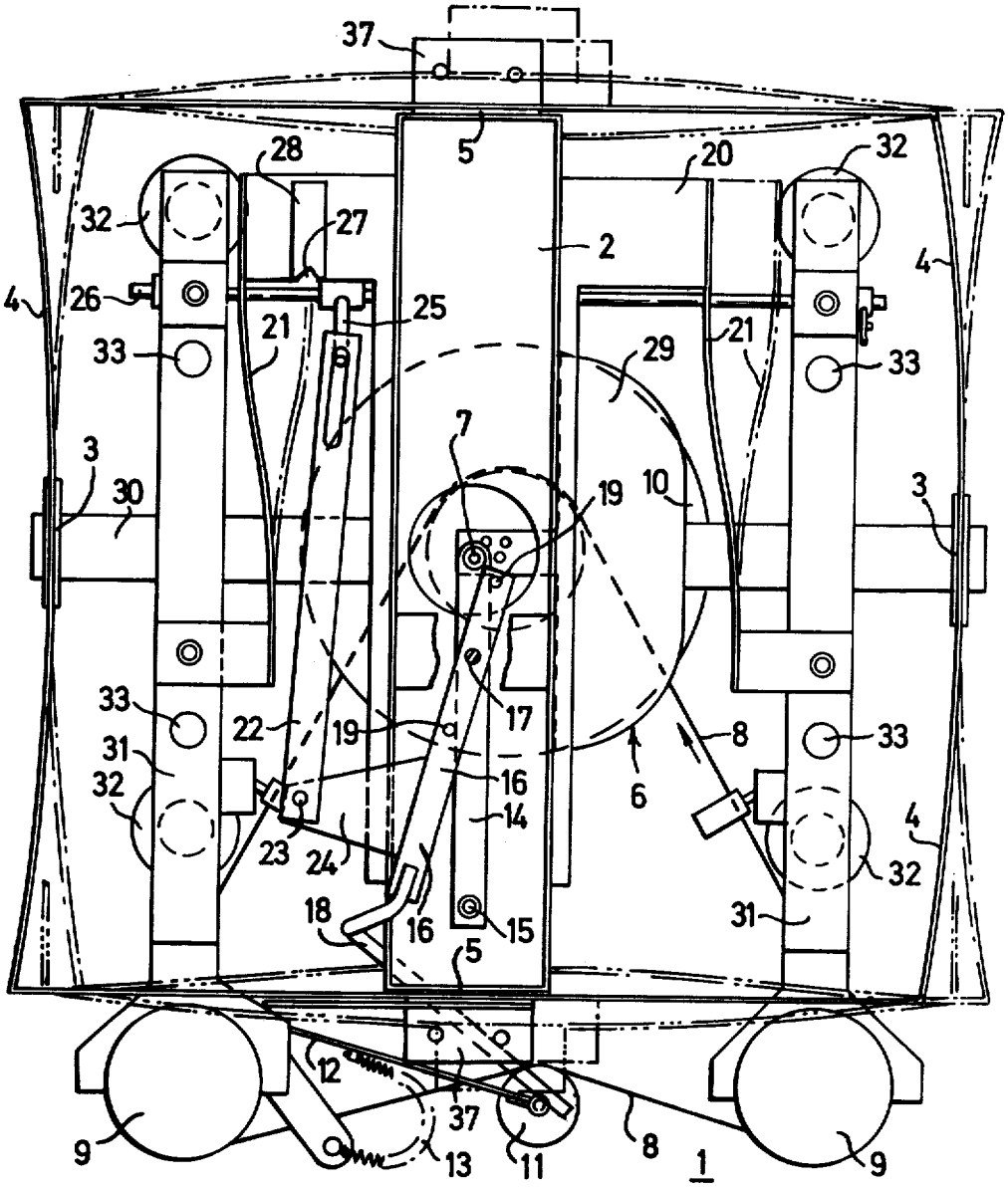
FIG. 1 is a plan view of a mechanism embodying the invention, showing the member executing orbital motion.

During the course of this invention like numbers will be used to refer to like elements according to the different views of the invention.

Referring to the drawings, the illustrated mechanism 1 comprises a member 2 in the form of a beam, two spaced apart fixed supports 3, four resiliently flexible springs 4 joining each said support 3 to two spaced apart points or places 5 on the beam 2 such that an imaginary line, not shown, joining the said two places 5 on the beam 2 is transverse, i.e. perpendicular, to and intersected by an imaginary line, also not shown, joining said two fixed supports 3, by means 6 connected to the beam 2 for effecting orbital motion of the beam 2.

The two spaced apart places 5 on the beam 2 are the same for both supports 3, as shown, and are at opposite ends of the beam 2.

As shown, the resiliently flexible springs 4 form a rectangle, more particularly, a square, such that the two fixed supports 3 are in one pair of opposite sides of the square whereas the two spaced apart places 5 on the beam 2 are in the other pair of opposite sides of the square.

The means 6 connected to the beam 2 for effecting orbital motion of the beam 2 comprises a crank 7 which is rotatably driven by means of a flexible belt 8 from two electric motors 9. A pulley 10, around which the belt passes to drive the crank 7, has large diameter flanges for the purpose of retention of the belt 8. The belt 8 also passes around an idler 11 mounted on a pivoted arm 12 which is tensioned by means of a spring 13 in order to maintain tension on the belt 8. Pulleys 14 of the motors 9 have alternative belt grooves of different diameters in order to obtain different speeds of orbital motion of the beam 2 with the same speed of the motors 9.

The crank 7 is connected to an arm 14 which is pivoted at 15 to the beam 2. A second arm 16 is pivoted at 17 to the beam 2 and has a handle 18 for pivoting the arm 16 selectively to either of the two positions shown respectively in FIGS. 1 and 2.

In the position of the arm 16 shown in FIG. 1, two pins 19 on the arm 16 closely straddle the arm 14 to prevent the arm 14 from pivoting about the pivot 15, with the result that the beam 2 has to follow the orbital motion of the crank 7.

The beam 2 is slidably guided in a guide plate 20, by conventional means not shown, so that longitudinal movement of the beam 2 is possible at all times relative to the guide plate 20. The guide plate 20 is mounted on two resilient cantilevers 21 for reciprocal movement as shown in FIG. 1 transversely of the beam 2. The guide plate 20 remains always parallel to the position shown in FIG. 1, so that the beam 2 likewise always remains parallel to the position shown.

A third arm 22 is pivoted at 23 to a lateral extension 24 of the second arm 16. A rod 25 is fixed to, and extends laterally from, a shaft 26 which prevents the rod 25 from moving to the left or right of the position shown in FIGS. 1 and 2 but permits the rod 25 to pivot between the two positions shown respectively in FIGS. 1 and 2. In the position shown in FIG. 1, the rod 25 is inoperative. However, in the position shown in FIG. 2, the rod 25 engages a notch 27, see FIG. 1, in the guide plate 20 to restrain guide plate 20 and hence the beam 2 from lateral motion. A permanent magnet 28 is fixed to the guide plate 20 to hold the rod 25 in the position shown in FIG. 2. Furthermore, in the position shown in FIG. 2, the two pins 19 allow the arm 14 to pivot about the pivot 15, so that rotation of the crank 7 produces longitudinal linear reciprocating motion of the beam 2.

Figure 2:
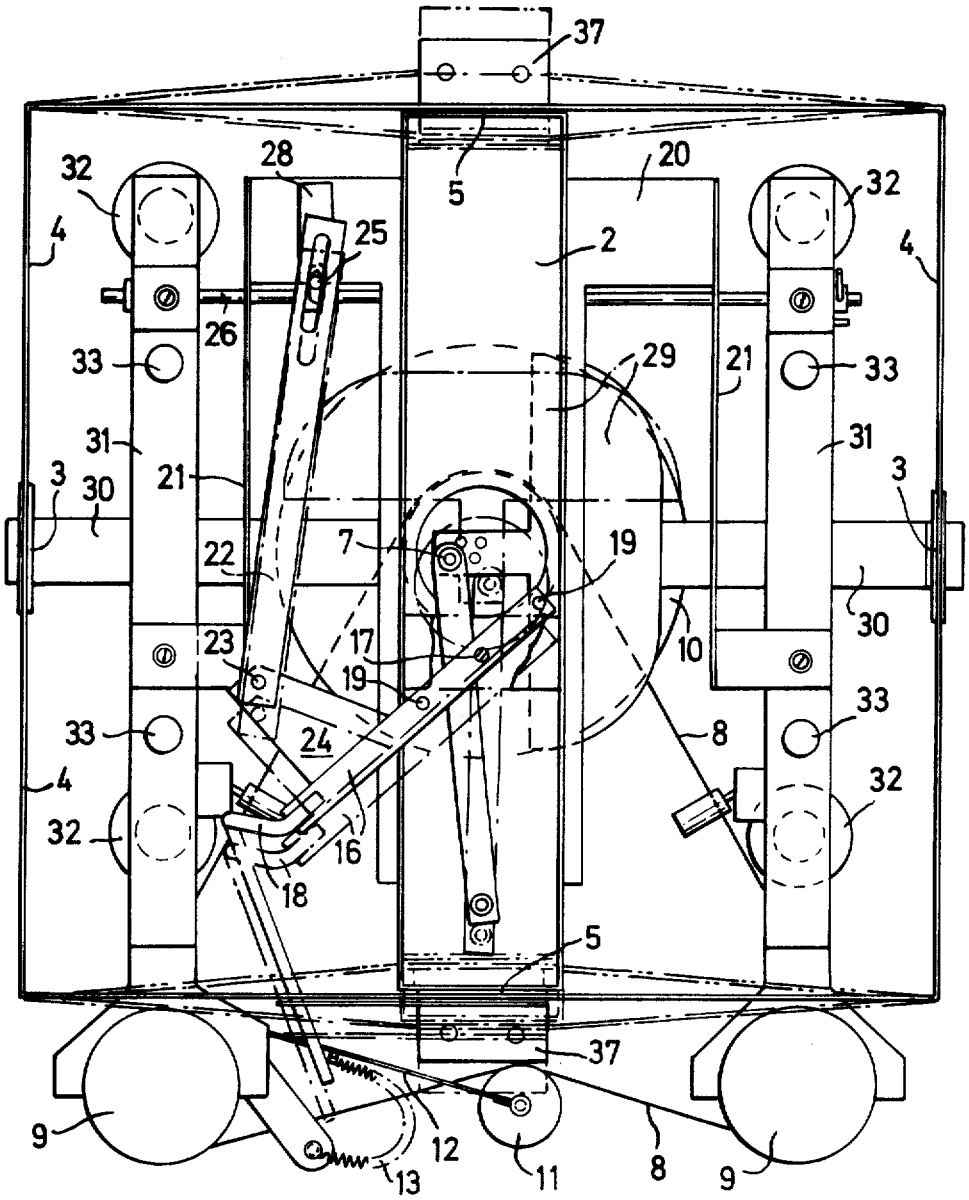
FIG. 2 is a similar plan view of the mechanism of FIG. 1, but showing the member executing linear reciprocating motion.

A counter-weight 29, as shown in FIG. 2, is connected to the crank 7 for counter-balancing the orbital motion of the beam 2.

The two fixed supports 3 are at opposite ends of a first cross-member 30 which is fixed to two cross-members 31 as shown. Four feet 32 are fixed to the two cross-members 31.

Four upstanding posts 33 are fixed to the cross-members 31 for supporting a stationary bath 34 as shown. Two carriers, only one of which is shown at 35 in FIG. 3, each comprising two upstanding arms 36 can be fixed to brackets 37 at the ends of the beam 2, the arms extending upwardly outside of the bath 34 for supporting one or more liquid containers, not shown, inside the bath 34. Hence, with the bath 34 stationary, the arms 36 effect orbital motion or linear reciprocating motion according to the setting of the arm 16, of the liquid containers inside the bath 34.

The two motors 9 are synchronous motors which can be left in a permanently stalled condition without harm.

During orbital motion of the beam 2, when moved by the rotating crank pin 7, it is possible for the beam to oscillate in an angular mode about the pin 7 if the frequency of such an oscillation is equal to the resonant frequency of such an oscillation.

The guide plate 20 is provided as a means of preventing this unwanted angular oscillation. This arrangement however introduces friction into the mechanism during operation. To reduce this friction an alternative embodiment of the invention is shown in FIG. 4.

Figure 3:
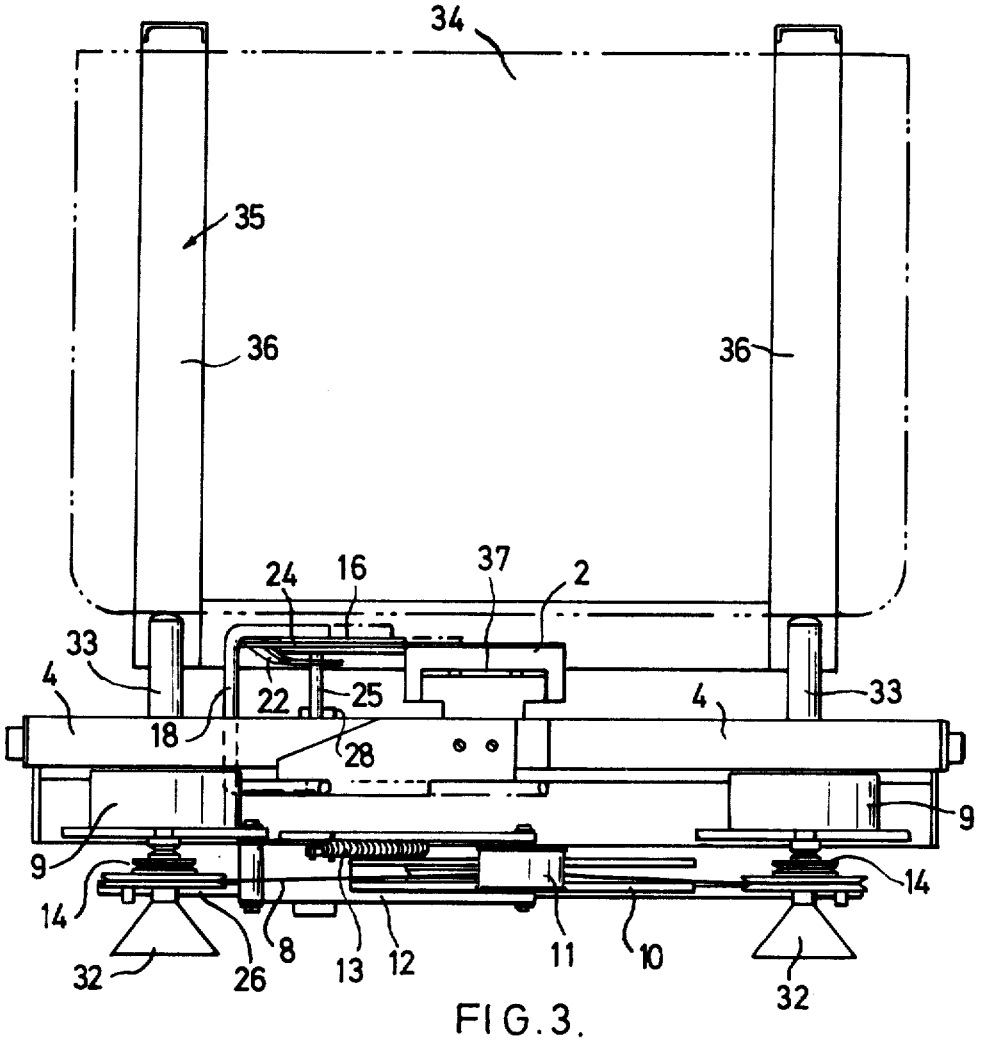
FIG. 3 is a side elevation of the mechanism of FIGS. 1 and 2, showing a bath and two carriers.
Figure 4:
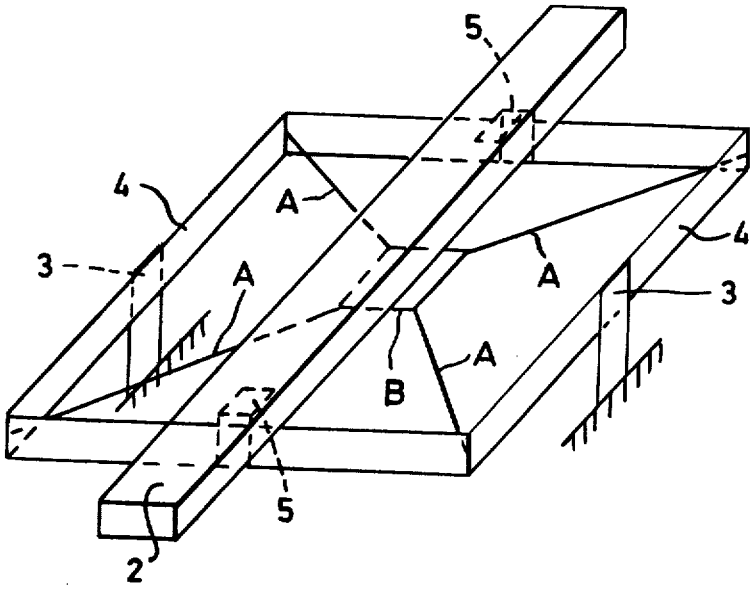
FIG. 4 is a schematic showing a mechanism for effecting orbital motion of a member incorporating means for preventing angular oscilation of the member during orbital motion.

The embodiment of FIG. 4 provides an alternative arrangement for inhibiting unwanted angular oscillation of the beam 2 during orbital motion thereof while reducing the above mentioned friction to a considerable extent. The said arrangement comprises cross wires A which are joined together by being attached respectively to the four corners of a square ring B positioned centrally of the rectangle or square formed by the resiliently flexible springs 4. The purpose of the ring B is to maintain the wires A out of the way of the rotatably driven crank pin 7 as disclosed with reference to FIGS. 1 to 3 for effecting orbital motion of the member 2.

Figure 5:
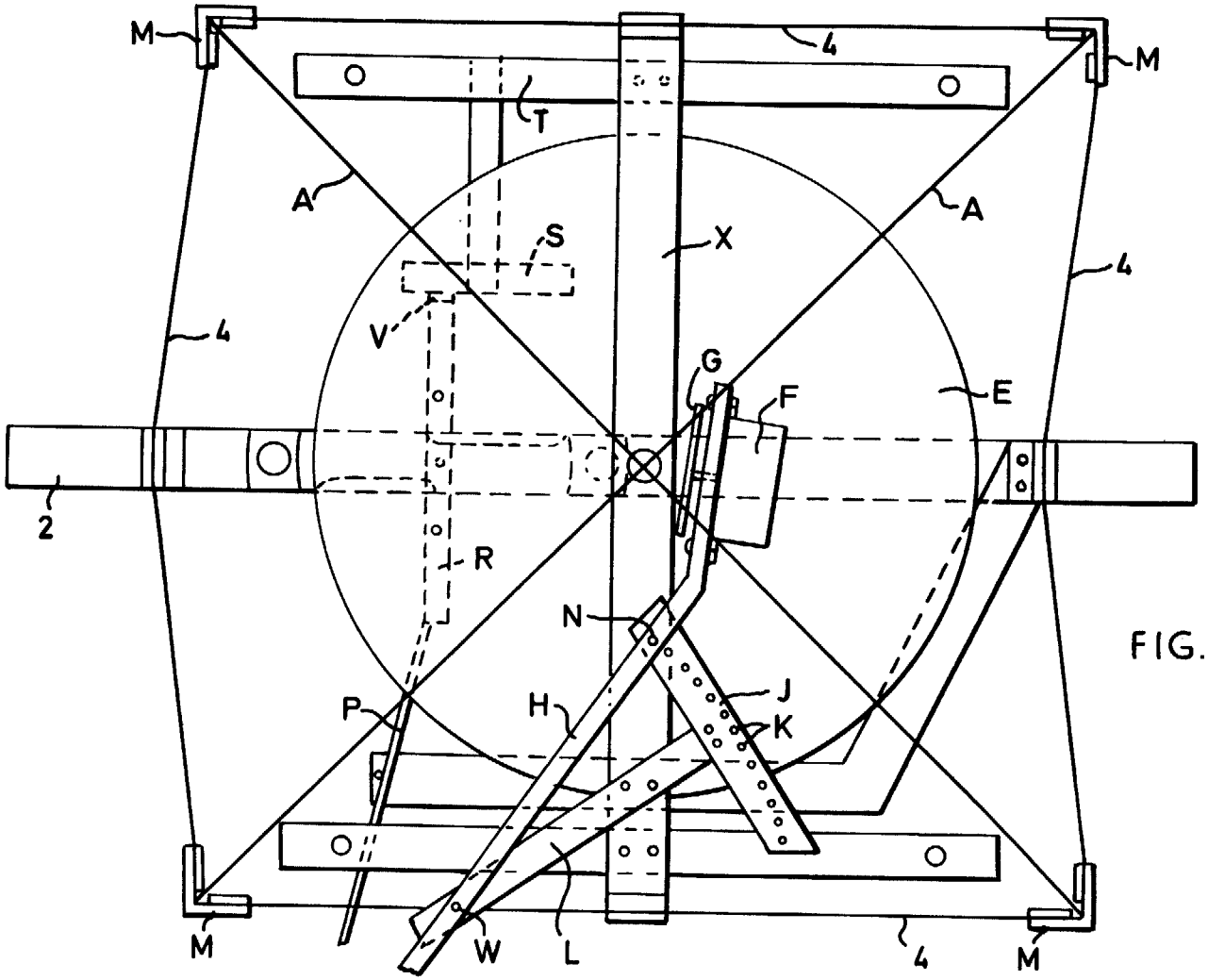
FIG. 5 is a further schematic of a mechanism for effecting orbital motion of a member incorporating an alternative form of the means of FIG. 4 and showing drive means for driving the mechanism.
Figure 6:
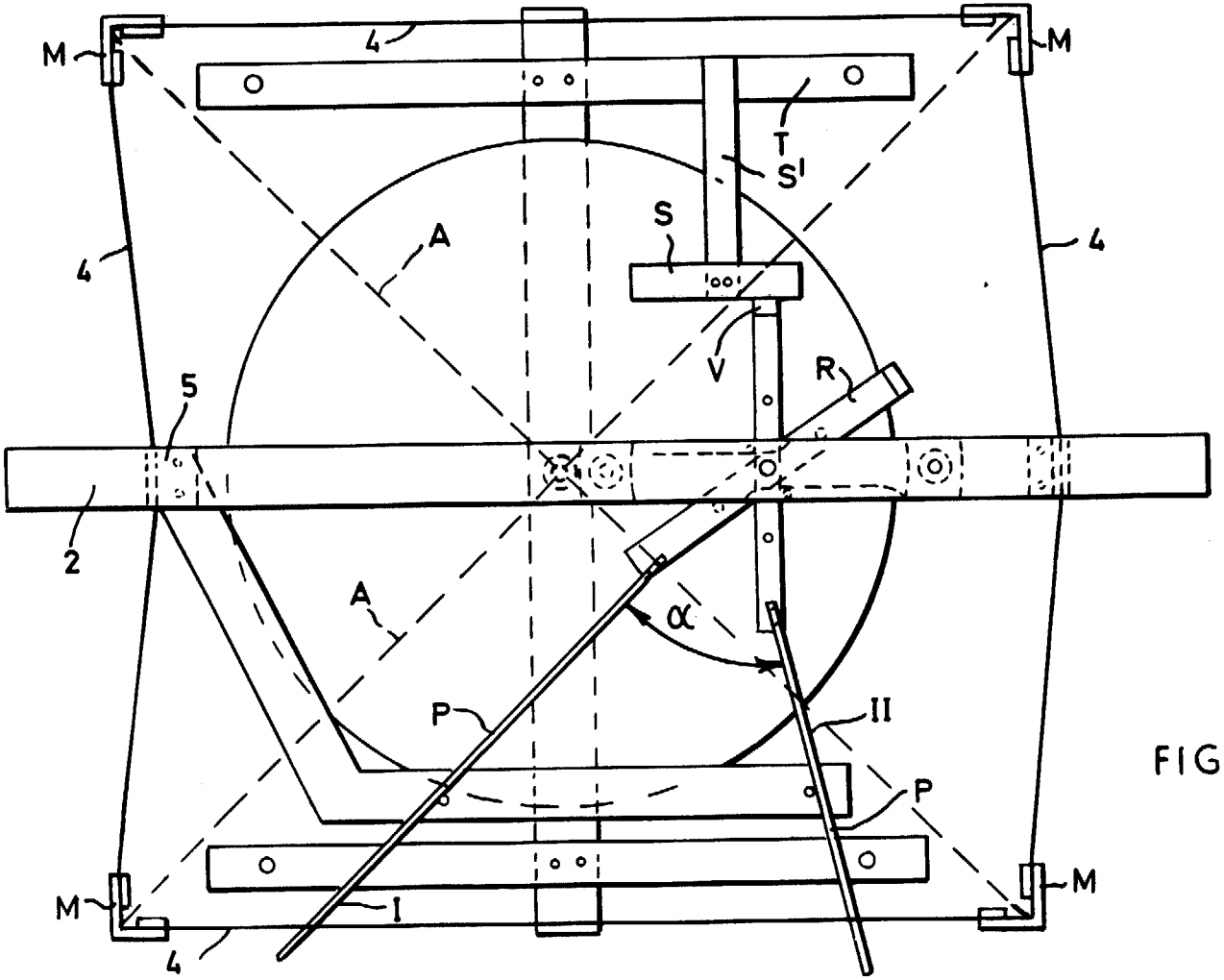
FIG. 6 is a bottom plan view of the mechanism of FIG. 5.

An alternative form of the embodiment of FIG. 4 is illustrated in FIGS. 5 and 6. Here the cross wires A are held diagonally between posts M positioned at the corners of the rectangle or square 4. In this way the wires are elevated to a position away from interference with the rotatably driven crank pin referred to above. The wires A in FIG. 5 may or may not be jointed at the points where they cross one another. Also it should be noted that the cross wires A in both FIGS. 4 and 5 may be replaced by rigid crossed diagonal members and the same improved effect to obviating unwanted angular oscillation around the crank pin will be achieved.

The employment of cross wires A as shown in FIGS. 4, 5 and 6 results in a considerable reduction in friction during operation of the mechanism. This reduction in friction means that only one synchronous motor need be used to drive the mechanism instead of two as is required in the embodiment as described with reference to FIGS. 1 to 3.

A means of driving the mechanism in this way is shown in FIG. 5, and basically comprises a synchronous motor F driving a flywheel or turntable E by way of a friction disc G.

The synchronous motor F is connected to an arrangement of levers H, J and L for altering the position of the motor F on the flywheel E. Specifically the motor F is attached to a lever H which extends from the motor F at an angle of preferably 150° to the plane of the friction disc G.

The lever H is swivelably moveable at point W on an arm L attached to a cross member X of the mechanism. Attached to the other end of the arm L is a cross piece J having a series of circumferentially spaced holes K. The lever H is provided with a peg N. The peg N is engageable with respective ones of the holes K during swiveling movements of the lever H with respect to the arm L. In this way the position of the motor F can be adjusted on the flywheel E. The lever H can thus be viewed as an operating lever to change the speed of rotation of the flywheel E.

As mentioned above the use of cross wires A ensures that the beam 2 moves parallel to itself during reciprocating motion so that unwanted angular oscillation is obviated. However sideways parallel motion is still possible when reciprocating and this of course is undesirable. A means of obviating this sideways parallel motion during reciprocation is shown in the embodiment of FIGS. 5 and 6. It basically comprises a lever P attached to an elongated arm R pivotally mounted substantially at its centre on the beam 2. The free end of the arm R is provided with a plastic peg V. The arm R is moveable on the beam 2 via the lever P through an angle as shown in FIG. 6 from a position I when orbital motion of the beam 2 is required to a position II when reciprocating motion of the beam 2 is required. In the reciprocating position II of the lever P the peg V is positioned for movement parallel to a plastic straight edge provided by an elongate arm S attached to the immoveable main frame T of the mechanism via an arm S'. Thus as the beam 2 performs reciprocating motion the plastic peg moves parallel to the straight edge provided by the arm S and prevents sideways oscillation of the beam 2.

Figure 7:
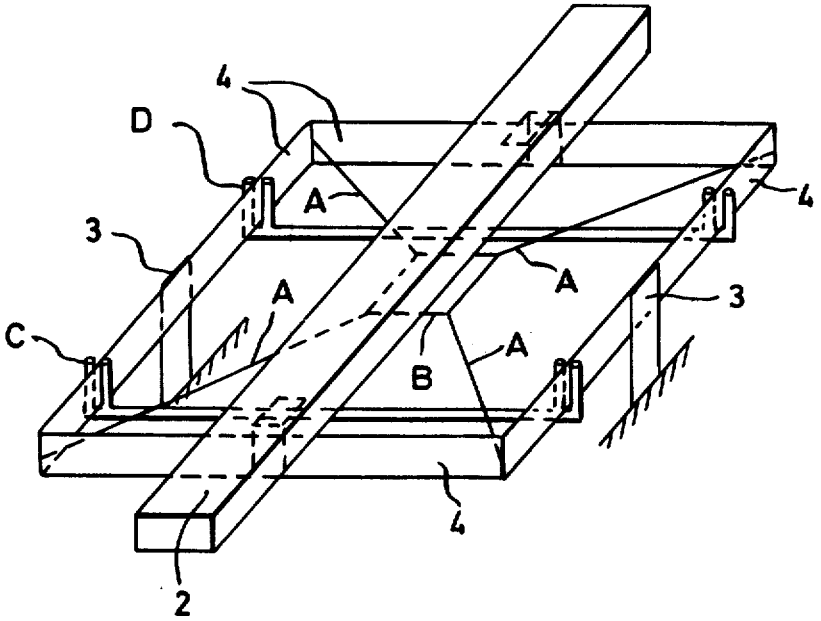
FIG. 7 is a schematic of a mechanism for effecting orbital motion of a member incorporating the means of FIG. 4, and further incorporating means for increasing the resistance to buckling of the flexible rectangular spring means of the mechanism when a load is imposed on the rigid beam.

A further embodiment of the mechanism of FIGS. 1 to 3 is shown in FIG. 7. This arrangement is advantageous when heavy vertical loads are imposed on the mechanism as, for example, when shaking a large vessel full of liquid. It employs rigid cross members C and D which are clamped at each end to respective sides of the rectangle formed by the springs 4. C and D are positioned to be transverse to the longitudinal direction of the beam 2 and spaced respectively to each side of an imaginary centre line passing transversely through the beam 2. This arrangement increases the resistance to buckling of the square or rectangular loop formed by the springs 4.

The arrangement shown in FIG. 7 is shown incorporated into the embodiment of the mechanism shown in FIG. 4. However it can equally well be employed in the embodiment of FIGS. 1 to 3 to strengthen the structure when dealing with heavy vertical loads.

The device just described has the following advantages over typical prior art shakers. First, the device has a relatively uncomplicated structure and is therefore capable of being manufactured at a relatively low cost per item. Second, the shaker mechanism can be selectively used either as an orbital shaker or reciprocating shaker. Accordingly, it is not necessary to buy two separate shakers—one to perform orbital shaking and the other to perform reciprocating shaking. Third, due to its unique structure, the mechanism is capable of running on extremely low power. Fourth, the mechanism has relatively high reliability. Fifth, the mechanism is relatively compact.

The shaker just described is in many respects a universal shaker. It can be used as a conventional shaker or as a water bath shaker. Orbital or reciprocating motion can be chosen simply by movement of a lever. The device is also explosion proof and produces no significant amount of heat. Moreover the speed is variable, the stroke is also variable and the device can be constructed with a tachometer.

The term orbital may be used during the course of this disclosure to include the term reciprocal. Orbital movement is created by two oscillations at right angles to each other. Reciprocal movement is a special case where one of the oscillations is zero. Circular motion is a special case where both oscillations are of equal magnitude. Accordingly, the term orbital may be used generically to include the terms reciprocal and circular as well.

While the invention has been described in detail with respect to a preferred embodiment thereof, it will be appreciated by those of ordinary skill in the art that certain modifications may be made to the structure and selection of the elements without departing from the spirit and scope of the invention.

I claim:

1. An apparatus for producing a shaking motion comprising:

a member having two spaced apart points thereon;

two fixed supports;

resiliently flexible spring means for connecting said two spaced apart points on said member to said two fixed supports so that a hypothetical line joining said two points on said member is transverse to and intersected by a hypothetical line joining said two fixed supports; and, means connected to said member for effecting motion of said member.

2. The apparatus of claim 1 wherein said member comprises a beam and said two spaced apart points are located near opposite ends of said beam.

3. The apparatus of claim 2 wherein said resiliently flexible spring means forms a rectangle such that said two fixed supports are attached to two opposite sides of said rectangle and further wherein the two spaced apart points on said beam are respectively connected to the two remaining opposite sides of said rectangle.

4. The apparatus of claim 3 wherein said means for effecting motion of said member comprises a rotatably driven crank.

5. The apparatus of claim 4 wherein said rectangle is provided with cross wire means for inhibiting unwanted angular oscillation of said beam during the motion thereof.

6. The apparatus of claim 5 wherein said cross wire means comprise:

a pair of crossed wires connected to the four corners of said resiliently flexible spring means; and, a square ring means positioned centrally of the rectangle formed by said resiliently flexible spring means, wherein said crossed wires are joined together respectively to each of the four corners of said square ring means.

7. The apparatus of claim 5 further including:

posts located at the four corners of the rectangle formed by said resiliently flexible spring means; and, said crossed wire means comprises a pair of wires each connected to one of said posts at one end of said resiliently flexible spring means and also connected to the post located diagonally across therefrom.

8. The apparatus of claim 7 wherein said crossed wires are relatively rigid.

9. The apparatus of claim 5, said means for effecting motion of said member comprising a synchronous motor.

10. The apparatus of claim 9 wherein said apparatus further includes:

a flywheel means rotatably connected to said apparatus; and, a friction disc means connected to said synchronous motor and positioned so as to impinge upon the surface of said flywheel means.

11. The apparatus of claim 10 further including:

means for selectively positioning said synchronous motor with respect to said flywheel means in order to change the speed of rotation of said flywheel means.

12. The apparatus of claim 11 further including:

an arm means connected to said crank and pivotally connected to said member and including means whereby said crank can be selectively prevented from pivoting to cause the motion of said beam, said apparatus further including a: selectively operable means for constraining said beam to a linear reciprocating motion when the crank is free to pivot.

13. The apparatus of claim 12 further including:

means for preventing sideways parallel motion of said beam during the linear reciprocating motion thereof.

14. The apparatus of claim 13 further including spaced rigid crossed members clamped at each end to the respective four sides of the rectangle formed by said resilient flexible spring means.

15. The apparatus of claim 14 wherein said selectively operable means comprises a guide means mounted on a plurality of resilient cantilevers for reciprocal movement transversely of the direction of said linear reciprocating motion of said beam, which is slidably guided by said guide means.

16. The apparatus of claim 15 further comprising:

a container for containing a liquid bath; and, means for suspending said container from a carrier connected to said member.

* * * * *